US008499706B2

(12) United States Patent
Porrini

(10) Patent No.: US 8,499,706 B2
(45) Date of Patent: Aug. 6, 2013

(54) APPROACHING AND RETAINING DEVICE, IN PARTICULAR FOR A BOAT DOOR

(75) Inventor: Sergio Porrini, Bruino (IT)

(73) Assignee: Seatech Engineering SNC di Mario Ignazi Casalegno E Sergio Porrini, Bruino (IT)

( * ) Notice: Subject to any disclaimer, the term of this patent is extended or adjusted under 35 U.S.C. 154(b) by 112 days.

(21) Appl. No.: 13/318,108

(22) PCT Filed: Apr. 28, 2010

(86) PCT No.: PCT/IB2010/051861

§ 371 (c)(1),
(2), (4) Date: Oct. 28, 2011

(87) PCT Pub. No.: WO2010/125530

PCT Pub. Date: Nov. 4, 2010

(65) Prior Publication Data

US 2012/0060739 A1 Mar. 15, 2012

(30) Foreign Application Priority Data

Apr. 29, 2009 (IT) ..... TO2009A0336

(51) Int. Cl.
*B63B 11/00* (2006.01)
*E05C 1/04* (2006.01)

(52) U.S. Cl.
USPC ..... 114/117; 292/149

(58) Field of Classification Search
USPC ..... 114/116, 117, 201 R; 292/149
See application file for complete search history.

(56) References Cited

U.S. PATENT DOCUMENTS

| | | | | |
|---|---|---|---|---|
| 3,753,414 | A * | 8/1973 | Enochian | 410/119 |
| 5,199,369 | A * | 4/1993 | Meyer et al. | 114/117 |
| 5,271,181 | A * | 12/1993 | Pietro | 49/118 |
| 5,661,935 | A * | 9/1997 | Erickson et al. | 52/202 |
| 5,943,736 | A * | 8/1999 | Karkkainen et al. | 16/79 |
| 6,205,713 | B1 * | 3/2001 | Thompson et al. | 49/465 |

(Continued)

FOREIGN PATENT DOCUMENTS

| | | |
|---|---|---|
| DE | 3631043 | 9/1986 |
| DE | 3642907 | 12/1986 |
| FR | 2 687 718 | 8/1993 |

OTHER PUBLICATIONS

International Search Report issued Sep. 16, 2010 in Application No. PCT/IB2010/051861, filed Apr. 28, 2010.
Written Opinion issued Sep. 16, 2010 in Application No. PCT/IB2010/051861, filed Apr. 28, 2010.

*Primary Examiner* — Stephen Avila
(74) *Attorney, Agent, or Firm* — Workman Nydegger

(57) ABSTRACT

An approaching and retaining device, in particular for a boat door, includes a fixed assembly adapted to be associated with a frame and a mobile assembly adapted to be associated with a wing. The fixed assembly includes a nib which can slide freely in a first through hole of the mobile assembly; structure for automatically operating an actuator connected to the nib in a manner to determine an approaching movement of the wing towards the frame and a compression force against an elastic element positioned between the frame and the wing. The mobile assembly includes an external element rigidly secured to the wing; an internal strike adapted to be inserted into a second through hole of the main body, the internal strike including a transversal hole adapted to house the nib; and a threaded pin which allows the internal strike to move relative to the external element.

15 Claims, 4 Drawing Sheets

U.S. PATENT DOCUMENTS 6,226,835 B1 * 5/2001 Cress ..... 16/260
6,240,598 B1 * 6/2001 Moore ..... 16/61
6,299,009 B1 * 10/2001 Ryziuk et al. ..... 220/1.5
6,698,805 B2 * 3/2004 Erices et al. ..... 292/216
6,796,603 B2 * 9/2004 Pringnitz ..... 296/186.3
7,100,245 B2 * 9/2006 Wohlfarth ..... 16/367
7,281,481 B2 * 10/2007 Rising et al. ..... 114/117
2006/0186678 A1 8/2006 Meyers et al.

* cited by examiner

APPROACHING AND RETAINING DEVICE, IN PARTICULAR FOR A BOAT DOOR

BACKGROUND OF THE INVENTION

1. Field of the Invention

The present invention relates to an automatic approaching and retaining device suitable in particular for watertight doors and/or hatches, especially for boats, i.e. an element adapted to approach and compress an elastic element, such as a gasket, positioned between the fixed element (frame) and the mobile element (wing) of the door assembly.

2. Present State of the Art

The state of the art includes manually operated devices capable of approaching the wing to the frame; in particular, said manually operated devices feature the simultaneous forward movement of a set of nibs protruding from the wing and entering into suitable seats provided on the frame.

The means for controlling said set of nibs are typically positioned on the door wing and comprise at least one handle acting upon a system of levers adapted to drive the set of nibs.

As known, said control means usually comprise a pair of handles located on opposite sides of the door wing.

The control devices known in the art suffer from a few drawbacks.

As a matter of facts, locating said control means on the wing of a door implies a considerable increase in the weight of said door, resulting in disadvantages in terms of ease of closing said door.

Moreover, such an arrangement of the control devices on the door wing does not allow said door to be designed with a large glass area.

A further drawback caused by positioning the control devices on the door wing is that such a solution necessarily involves the use of a very thick wing, which may hinder people from passing through when the door wing is open, in particular in environments where the available room is small; this is especially important when the door is associated with a boat, since it is well known that there is not much room available on such means of transportation.

SUMMARY OF THE INVENTION

In this frame, it is the main object of the present invention to overcome the above-mentioned drawbacks by providing an approaching and retaining device, in particular for a door and/or a hatch of a boat, conceived in such a manner as to not increase the weight of said door and to allow said door to be closed easily.

It is another object of the present invention to provide an approaching and retaining device, in particular for a door and/or a hatch of a boat, which allows said door to be designed with a large glass area.

It is a further object of the present invention to provide an approaching and retaining device, in particular for a door and/or a hatch of a boat, which allows to manufacture an especially thin door wing, so as not to hinder the passage of the people, in particular in environments where the available room is small; this requirement is particularly felt, for example, on boats.

According to the present invention, the manually operated devices positioned on the mobile element (wing) known in the art are replaced with an automatically operated device positioned on the fixed element (frame) of the door.

As a consequence, according to the present invention the mobile element (wing) is lighter and simpler in its construction, thereby allowing the use of any design solution without being constrained by the necessity of housing such mechanisms.

In addition, according to the present invention the movement, with which the door is approached to the frame and the elastic sealing element (gasket) positioned between the door wing and with which the door frame is compressed, is controlled automatically, thus facilitating the use of the door.

According to the present invention, an approaching and retaining device, in particular for doors and hatches of boats, is conceived which comprises a fixed assembly located inside the door frame and a mobile assembly integral with the door wing.

Such assemblies are shaped and positioned relative to each other in a manner such that the mobile assembly, as the wing approaches the frame, gradually occupies a suitable space within the fixed assembly located inside the frame. Said fixed assembly includes automatically operated mobile parts which, when operated, exert traction on the mobile assembly, thus compressing the elastic element (gasket) interposed between the wing and the frame.

These objects are achieved by the present invention through an approaching and retaining device, in particular for a door and/or a hatch of a boat, incorporating the features set out in the appended claims, which are intended as an integral part of the present description.

BRIEF DESCRIPTION OF THE DRAWINGS

Further objects, features and advantages of the present invention will become apparent from the following detailed description and from the annexed drawings, which are supplied by way of non-limiting example, wherein.

DETAILED DESCRIPTION OF THE PREFERRED EMBODIMENTS

The present description and said drawings are to be considered as non-limiting examples.

Figure 1:
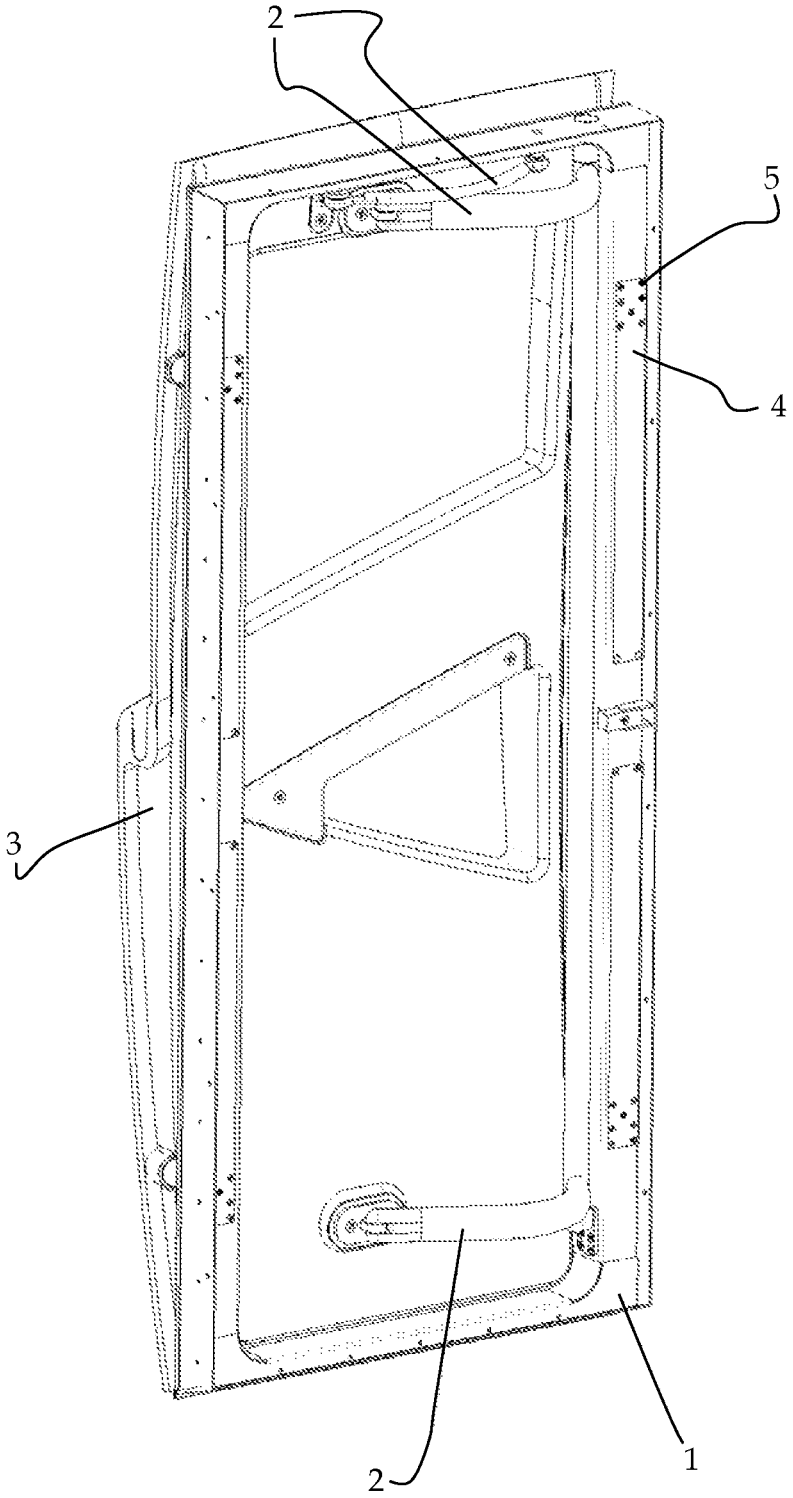
FIG. 1 is a perspective view of a door, in particular for boats.

FIG. 1 shows a door or hatch, in particular of a boat, comprising a frame 1, a wing 3 and connection means 2, in particular comprising arms and/or hinges, adapted to connect the frame 1 to the wing 3 and to allow the latter to be opened and/or closed.

Preferably, the door shown in FIG. 1 is suitable for use on a boat; it should also be pointed out that, in the following description, the term "door" will refer without distinction to a door or a hatch, in particular of a boat.

Figure 2A:
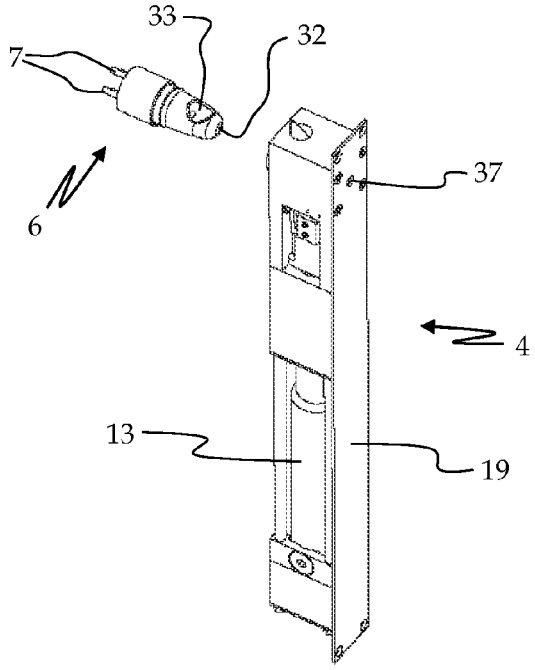
FIGS. 2*a* and 2*b* are, respectively, a first perspective view and a second exploded perspective view of an approaching and retaining device according to the present invention.
Figure 2B:
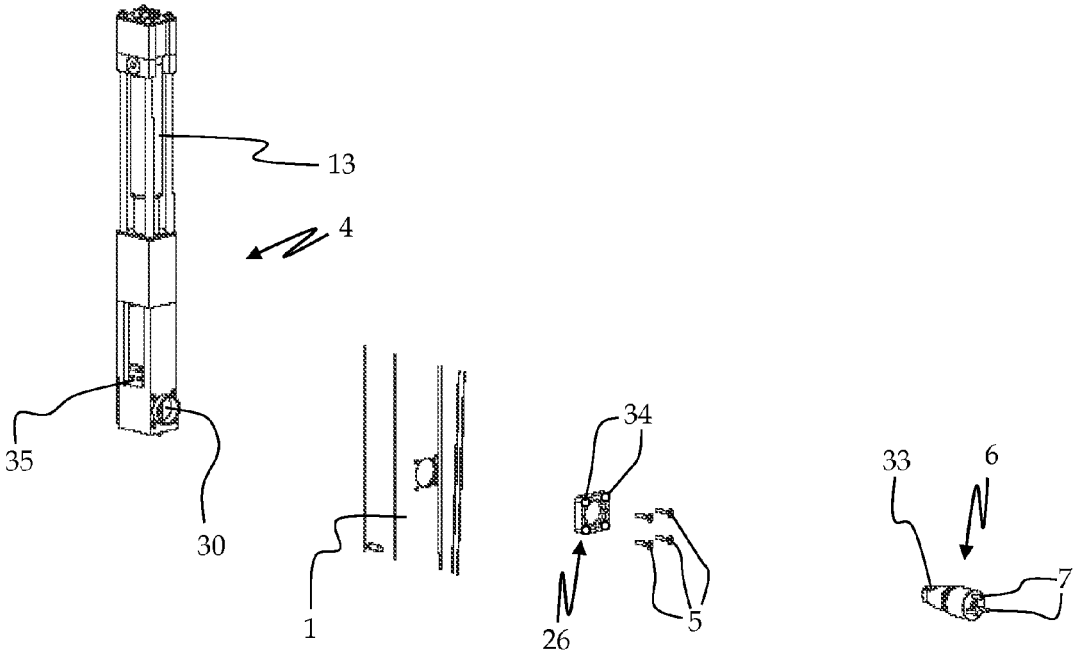

FIGS. 2*a* and 2*b* show an approaching and retaining device, in particular for a boat door, according to the present invention. In particular, FIG. 2*a* is a first perspective view of said device, whereas FIG. 2*b* is a second perspective view, partially exploded, of said device.

The approaching and retaining device comprises a fixed assembly 4 adapted to be associated with the frame 1, in particular through fastening means 5, such as for example a plurality of screws.

The approaching and retaining device preferably comprises a guide block 26 adapted to be associated with the frame 1 through said fastening means 5; to this end, the guide block 26 includes holes 34 for inserting said fastening means 5.

Still with reference to FIGS. 2*a* and 2*b*, it can be seen that the approaching and retaining device according to the present invention comprises a mobile assembly 6 adapted to be associated with the wing 3, in particular through additional fastening means 7.

Figure 3:
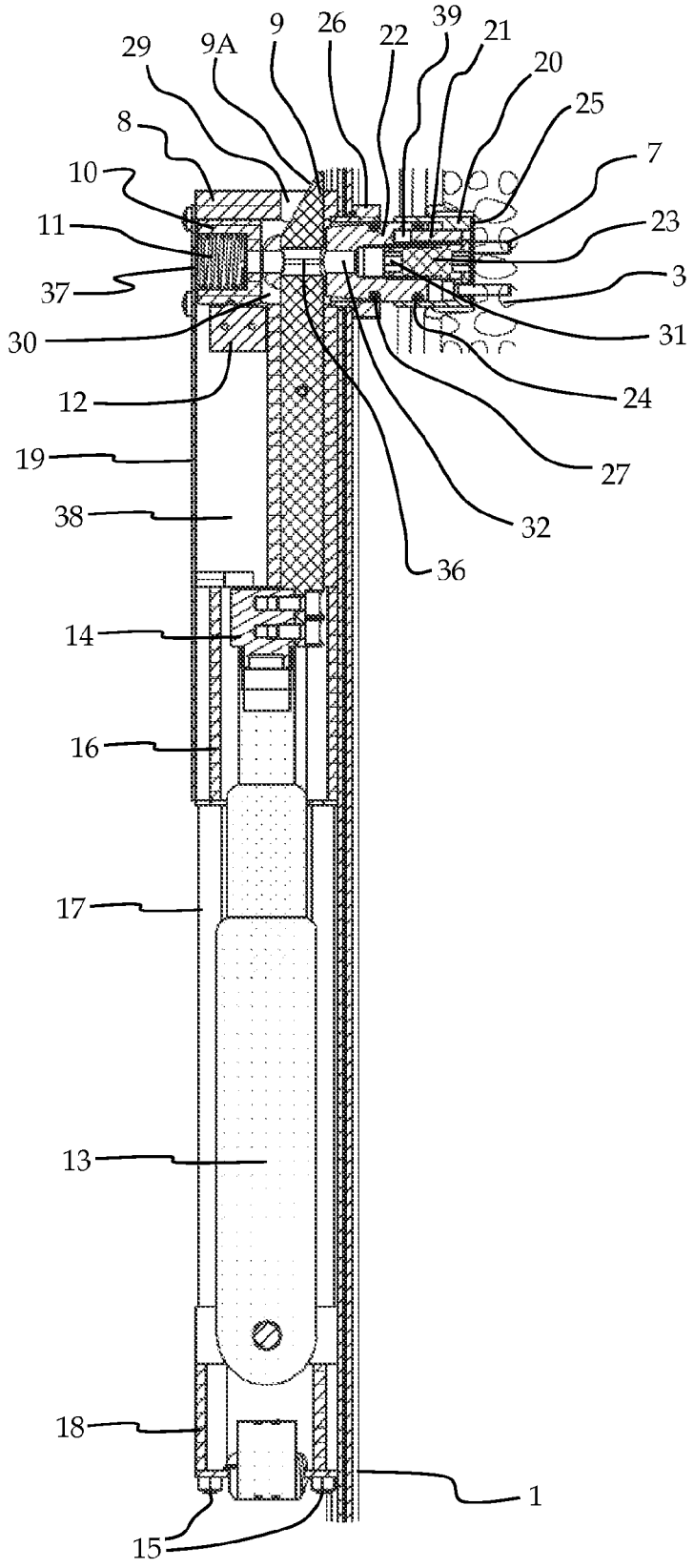
FIG. 3 is a sectional view in a vertical plane of the approaching and retaining device according to the present invention.
Figure 4:
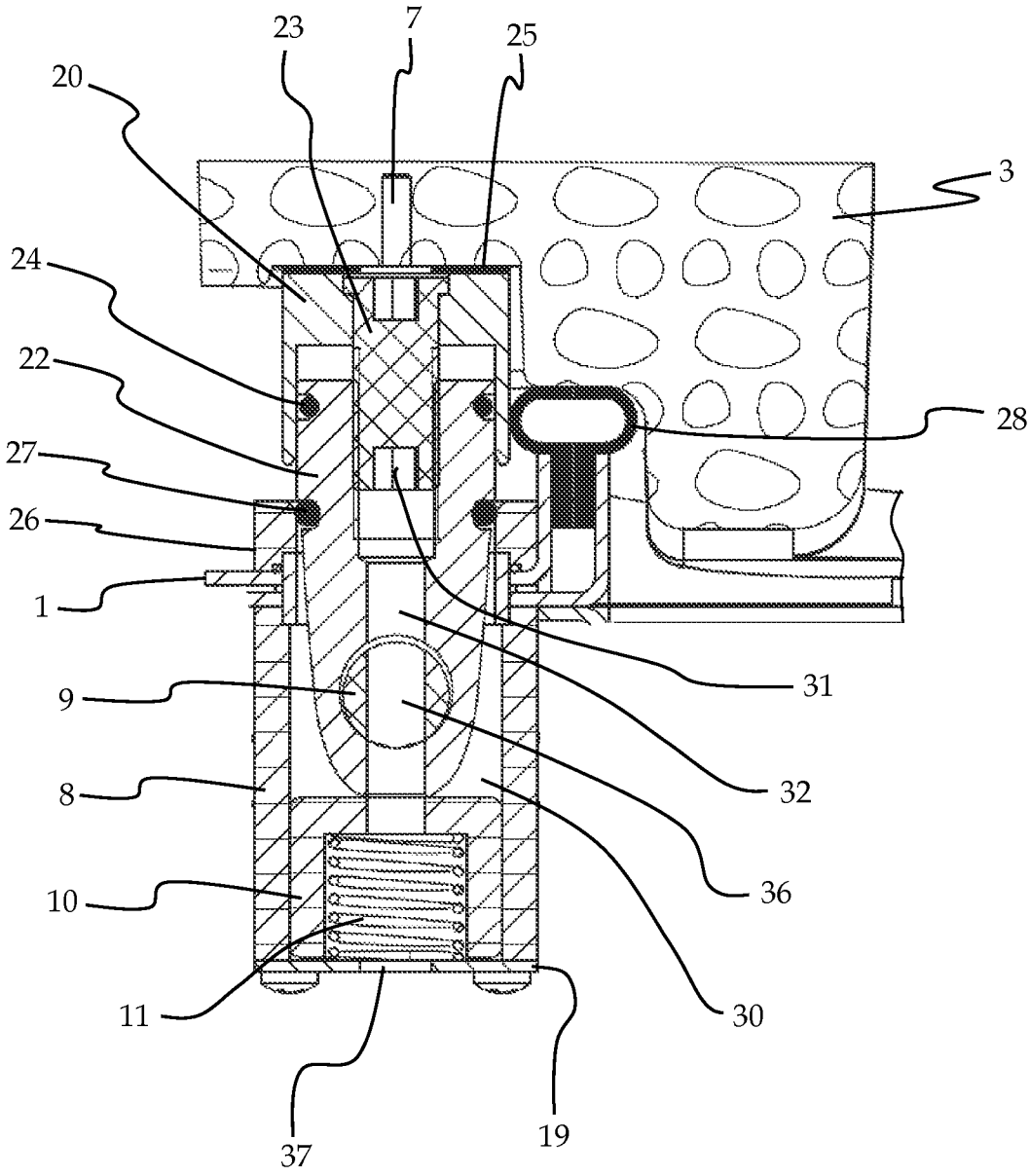
FIG. 4 is a sectional view in a horizontal plane of the approaching and retaining device according to the present invention.

FIGS. 3 and 4 show, respectively, a vertical sectional view and a horizontal sectional view of the approaching and retaining device, in particular for a boat door, according to the present invention.

From these drawings it can be noticed that the fixed assembly 4 of the approaching device comprises a nib 9 which can slide freely in a first through hole 29 of a main body 8; preferably, said nib 9 comprises an inclined end 9A to facilitate the coupling between the nib 9 and the mobile assembly 6.

Furthermore, said fixed assembly 4 comprises activation means 10, 11, 12 for automatically operating an actuator 13 connected to the nib 9 in a manner such that, as the wing 3 approaches the frame 1, the automatic movement of the nib 9 and the interaction of the nib 9 with the mobile assembly 6 determine an approaching movement of the wing 3 towards the frame 1 and a compression force against an elastic element 28 positioned between the frame 1 and the wing 3.

In particular, said activation means comprise a cursor 10, a spring 11 and a microswitch 12, said microswitch 12 being operated by the cursor 10 pushed by the wing 3 approaching the frame 1 by means of the internal strike 22 entering into the second through hole 30.

Said second through hole 30 is substantially perpendicular to said first through hole 29 and houses the cursor 10 and the spring 11.

Preferably, said microswitch 12 is located inside a groove 38.

In particular, said actuator 13 is an electric linear actuator connected to the nib 9 through a joint 14, which frees the axial position of the actuator 13 relative to the nib 9. As a consequence, said joint 14 allows the axis of the nib 9 to be set closer to the wing 3 and the length of the mobile assembly 6 to be reduced.

As an alternative, said actuator 13 may comprise a gearmotor coupled to a worm screw to generate the automatic movement of the nib 9; said gearmotor and said worm screw are not shown in the drawings.

Suitable connection means 15, 16, 17, 18 provide a rigid connection of the actuator 13 to the main body 8; preferably, said connection means comprise tie rods 15 and spacers 16, 17, 18.

The fixed assembly 4 also comprises a cover 19 which closes the second through hole 30 and acts as a support element for the spring 11.

The mobile assembly 6 of the approaching a retaining device according to the present invention comprises:

- an external element 20 rigidly secured to the wing 3;
- an internal strike 22 adapted to be inserted into said second through hole 30, said internal strike 22 including a transversal hole 33 adapted to house the nib 9;
- a threaded pin 23 which allows the internal strike 22 to move relative to the external element 20.

The external element 20 is secured to the wing 3 through said additional fastening means 7 of the mobile assembly 6.

Said threaded pin 23 comprises a visible end with a socket 31, in particular having a hexagonal shape, adapted to house a tool for unscrewing and/or screwing the threaded pin 23 in order to determine said movement of the internal strike 22 relative to the external element 20.

In a condition in which the wing 3 has been approached to the frame 1 (i.e. when the door is substantially closed), a radial passage 36 of said nib 9 is aligned with an axial hole 32 of the internal strike 22, with an aperture 37 of the cover 19, and with the socket 31 of the threaded pin 23, thus allowing access to said socket 31.

Said access to the socket 31, preferably an hexagonal one, allows to screw and/or unscrew the threaded pin 23 in order to adjust the position of the wing 3 relative to the frame 1, as well as to fully unscrew the threaded pin 23 in order to unlock and open the door as an emergency measure.

Suitable sealing means, in particular comprising rings 24 of the "OR" type and a gasket 25, ensure that all the couplings are watertight.

As aforementioned, outside the surface of the frame 1 there is a guide block 26, which rests on a ring 27 housed in a groove (not shown in the drawings) provided on the internal strike 22; said ring 27 is preferably of the "OR" type and ensures the tightness of the coupling between the fixed assembly 4 and the mobile assembly 6 of the approaching and retaining device according to the present invention.

Between the frame 1 and the wing 3 there is an elastic element 28, in particular a gasket; the compression of said elastic element 28 ensures a watertight seal between said frame 1 and said wing 3.

The following will describe the operation of the approaching and retaining device, in particular for a boat door, according to the present invention.

As the wing 3 approaches the frame 1 along the trajectory determined by the kinematics of the connection means 2 (in particular comprising arms or hinges), the internal strike 22 enters into the second through hole 30 in the main body 8 and, by overcoming the force of the spring 11, moves the cursor 10 backwards, thereby exciting the microswitch 12.

The excitation of the microswitch 12 provides the command for the actuator 13, which pushes the nib 9 along the first through hole 29 in the main body 8. The inclined end 9A of the nib 9 enters into the transversal hole 33, which is perpendicular to the axis of the internal strike 22, and exerts a traction force on the whole mobile assembly 6 to compress the elastic element 28, thereby ensuring a watertight closure of the wing 3 against the frame 1.

The movement of the actuator 13 ends when it reaches its end-of-travel position; said end-of-travel position may also be set by a second microswitch 35 (visible in FIG. 2*b*).

In this configuration, the radial passage 36 of the nib 9, the axial hole 32 of the strike 22, the aperture 37 of the cover 19 and the socket 31 of the threaded pin 23 are aligned.

This allows access to said socket 31, from the inside and with the door closed, for screwing and/or unscrewing the threaded pin 23 and adjusting the position of the wing 3 relative to the frame 1. In addition, by fully unscrewing the threaded pin 23 one can also open the door manually in the event of an emergency.

The approaching and retaining device according to the present invention preferably comprises a plug 21 rigidly secured to the external element 20 and engaging into a housing 39 of the internal strike 22; advantageously, said plug 21 allows to prevent the internal strike 22 from turning accidentally and, consequently, to keep the transversal hole 33 in the correct position, suitable for the insertion of the nib 9.

The closed device can be opened normally by means of a control (not shown in the drawings) arranged outside and/or inside the door and/or hatch, said control being such as to supply power to the linear actuator 13 until it reaches its end-of-travel position. Said end-of-travel position may also be set by a third microswitch (not shown in the drawings)

The features and advantages of the approaching and retaining device, in particular for a door or a hatch of a boat, according to the present invention are apparent from the above description.

In particular, the present invention provides an approaching and retaining device, in particular for a boat door, which comprises a fixed assembly 4 located inside the door frame 1 and a mobile assembly 6 integral with the door wing 3.

This solution does not increase the weight of said door, thus allowing it to be closed easily; in addition, this solution allows the wing 3 to include a large glass area, since the fixed assembly 4 is arranged within the door frame 1.

Because the wing 3 has no handles nor any other bulky items and is therefore particularly thin, the approaching and retaining device will not hinder the passage of the people, in particular on boats, where the available room is especially small.

Another advantage of the present invention is that the automatic movement of the nib 9 arranged in the fixed assembly 4 and the interaction thereof with the mobile assembly 6 determine an approaching movement of the wing 3 towards the frame 1 which is adapted to exert an optimal compression force on the elastic element 28 positioned between the frame 1 and the wing 3, thereby ensuring a watertight seal between said frame 1 and said wing 3.

A further advantage of the present invention is that the mutual alignment of the radial passage 36 of the nib 9, the axial hole 32 of the internal strike 22, the aperture 37 of the cover 19 and the socket 31 of the threaded pin 23 allows to screw and/or unscrew the threaded pin 23 for adjusting the position of the wing 3 relative to the frame 1, as well as to fully unscrew the threaded pin 23 for unlocking and opening the door as an emergency measure. This advantage is especially important, if we consider that such operations can be carried out when the wing 3 is fully abutted against the frame 1, i.e. when the door is substantially closed.

It is however clear that many changes may be made to the approaching and retaining device, in particular for a boat door and/or hatch, according to the present invention, and that in its practical implementation the various components may have different shapes and arrangements or be replaced with other technically equivalent elements without departing from the novelty spirit of the inventive idea.

It can therefore be easily understood that the present invention is not limited to the above-described approaching and retaining device, in particular for a boat door and/or hatch, but may be subject to many modifications, improvements or replacements of equivalent parts and elements without departing from the inventive idea, as clearly specified in the following claims.

The invention claimed is:

1. Approaching and retaining device, in particular for a boat door, of the type comprising a fixed assembly adapted to be associated with a frame, and a mobile assembly adapted to be associated with a wing, said fixed assembly comprising:

a nib which can slide freely in a first through hole of a main body of said mobile assembly;

activation means for automatically operating an actuator connected to the nib in a manner such that, as the wing approaches the frame, the automatic movement of the nib and the interaction of the nib with the mobile assembly determine an approaching movement of the wing towards the frame and a compression force against an elastic element positioned between the frame and the wing, characterized in that said mobile assembly comprises:

an external element rigidly secured to the wing;

an internal strike adapted to be inserted into a second through hole of the main body, said internal strike including a transversal hole adapted to house the nib;

a threaded pin which allows the internal strike to move relative to the external element.

2. Device according to claim 1, characterized in that said actuator is an electric linear actuator connected to the nib through a joint.

3. Device according to claim 1, characterized in that said actuator comprises a gearmotor coupled to a worm screw.

4. Device according to claim 1, characterized in that said activation means comprise a cursor, a spring and a microswitch, said microswitch being operated by the cursor pushed by the wing approaching the frame by means of the internal strike entering into the second through hole.

5. Device according to claim 1, characterized in that, in a condition in which the wing is approached to the frame, a radial passage of said nib is aligned with:

an axial hole of the internal strike, an aperture of a cover of said fixed assembly, a socket provided on a visible end of said threaded pin, so that access is allowed to said socket for adjusting the position of the wing relative to the frame and/or for unlocking and opening the door as an emergency measure.

6. Device according to claim 5, characterized in that said cover allows the second through hole to be closed and acts as a support element for the spring.

7. Device according to claim 4, characterized in that said second through hole is substantially perpendicular to said first through hole and houses the cursor and the spring.

8. Device according to claim 4, characterized in that said microswitch is arranged within a groove.

9. Device according to claim 1, characterized by comprising a guide block positioned externally to the surface of the frame.

10. Device according to claim 9, characterized by comprising a ring, in particular of the "OR" type, housed in a suitable groove provided on the internal strike and resting on said guide block to ensure a watertight seal of the coupling between the fixed assembly and the mobile assembly.

11. Device according to claim 1, characterized by comprising a plug rigidly secured to the external element and engaging into a housing of the internal strike for the purpose of preventing said internal strike from turning accidentally.

12. Device according to claim 1, characterized by comprising a control arranged outside and/or inside the door and adapted to supply power to the linear actuator for the normal opening of the device.

13. Device according to claim 1, characterized by comprising at least one second microswitch for locating the end-of-travel position of said actuator.

14. Door or hatch, in particular of a boat, comprising at least one approaching and retaining device according to claim 1.

15. Boat comprising at least one approaching and retaining device, in particular for a door and/or a hatch, according to claim 1.

* * * * *